US011110340B1

(12) United States Patent
Emricson

(10) Patent No.: US 11,110,340 B1
(45) Date of Patent: Sep. 7, 2021

(54) MODULAR ASSEMBLY AND METHOD OF USE

(71) Applicant: Nic Emricson, Harvard, IL (US)

(72) Inventor: Nic Emricson, Harvard, IL (US)

( * ) Notice: Subject to any disclaimer, the term of this patent is extended or adjusted under 35 U.S.C. 154(b) by 0 days.

(21) Appl. No.: 16/568,536

(22) Filed: Sep. 12, 2019

(51) Int. Cl.

| | |
|---|---|
| ***A63F 3/00*** | (2006.01) |
| *A63H 33/10* | (2006.01) |
| *A63H 33/06* | (2006.01) |
| *A63H 33/08* | (2006.01) |

(52) U.S. Cl.
CPC ..... *A63F 3/00261* (2013.01); *A63F 3/00214* (2013.01); *A63F 3/0023* (2013.01); *A63F 3/00075* (2013.01); *A63F 2003/00388* (2013.01); *A63H 33/062* (2013.01); *A63H 33/082* (2013.01); *A63H 33/101* (2013.01); *A63H 33/105* (2013.01); *A63H 33/107* (2013.01)

(58) Field of Classification Search
CPC .. A63H 33/105; A63H 33/062; A63H 33/082; A63H 33/101; A63H 33/107; A63F 3/00261; A63F 3/0023; A63F 3/00533; A63F 3/00574
USPC ..... 273/283, 284, 276, 241, 287, 288, 290
See application file for complete search history.

(56) References Cited

U.S. PATENT DOCUMENTS

| | | | | |
|---|---|---|---|---|
| 2,461,535 A * | 2/1949 | Erhardt | A63H 33/088 446/104 |
| 5,149,236 A * | 9/1992 | Rapayelian | A47G 1/06 403/294 |
| 5,545,070 A * | 8/1996 | Liu | A63H 33/042 446/102 |
| 2015/0259910 A1* | 9/2015 | Montiel Reyes | E04C 1/00 52/604 |

OTHER PUBLICATIONS

Dragonlock™ by Fat Dragon Games, www.fatdragongames.com/fdgfiles/?page_id=2658.

* cited by examiner

*Primary Examiner* — Benjamin Layno

(57) ABSTRACT

This invention relates to a modular gaming map, where a set of components can be assembled into a variety of configurations to create a three-dimensional map as a supplement for simulated battles and role-playing games, and compatible with industry standard figurines and models.

16 Claims, 15 Drawing Sheets

MODULAR ASSEMBLY AND METHOD OF USE

BRIEF DESCRIPTION OF DRAWINGS

Non-limiting and non-exhaustive examples of several of the various embodiments of the present invention are described with references to the following figures, and reference numbers refer to the same features throughout the various views and embodiments unless otherwise specified.

Figure 1:
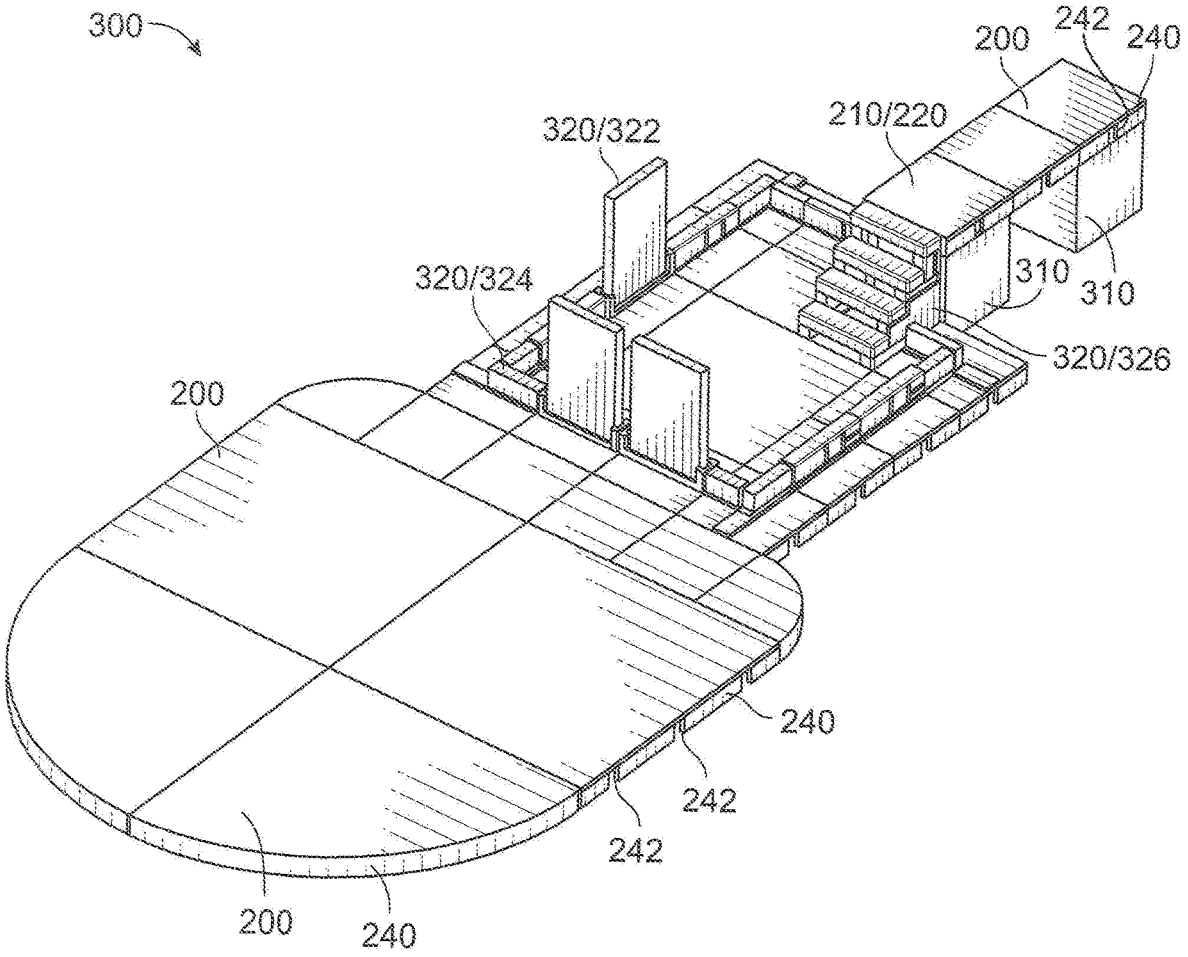
FIG. 1 is a top perspective illustration of an embodiment of a modular assembly, if seen assembled on a flat surface, showing a possible variety of modules with various vertical structures and elevators to create a potential configuration of an embodiment of the invention.

Corresponding reference characters indicate corresponding components throughout the several views of the drawings. Skilled artisans will appreciate that elements in the figures are illustrated for simplicity and clarity and have not necessarily been drawn to scale. Also, common but well-understood elements that are useful or necessary in a commercially feasible embodiment are often not depicted in order to facilitate a less obstructed view of these various embodiments. Common and easily configurable/variable. Additionally, the disclosed architecture is sufficiently configurable, such that it may be utilized in ways other than what is shown.

DETAILED DESCRIPTION OF INVENTION

In this Specification, which includes the figures, claims, and this detailed description, reference is made to particular and possible features of the embodiments of the invention, including method steps. These particular and possible features are intended to include all possible combinations of such features, without exclusivity. For instance, where a feature is disclosed in a specific embodiment or claim, that feature can also be used, to the extent possible, in combination with and/or in the context of other aspects and embodiments of the invention, and in the invention generally. Additionally, the disclosed architecture is sufficiently configurable, such that it may be utilized in ways other than what is shown.

The purpose of the Abstract of this Specification is to enable the U.S. Patent and Trademark Office and the public generally, and especially the scientists, engineers and practitioners of the art who are not familiar with patent or legal terms or phrasing, to determine quickly from a cursory inspection the nature and essence of the technical disclosure of the application. The Abstract is not intended to be limiting as to the scope of the invention in any way.

In the following description, numerous specific details are given in order to provide a thorough understanding of the present embodiments. It will be apparent, however, to one having ordinary skill in the art, that the specific detail need not be employed to practice the present embodiments. On other instances, well-known materials or methods have not been described in detail in order to avoid obscuring the present embodiments. When limitations are intended in this Specification, they are made with expressly limiting or exhaustive language.

Reference throughout this Specification to "one embodiment", "an embodiment", "one example" or "an example" means that a particular feature, structure, or characteristic described in connection with the embodiment or example is included in at least one embodiment of the present embodiments. Thus, appearances of the phrases "in one embodiment", "according to an embodiment", "in an embodiment", "one example", "for example", "an example", or the like, in various places throughout this Specification are not necessarily all referring to the same embodiment or example. Furthermore, the particular features, structures, or characteristics may be combined in any suitable combinations and/or sub-combinations in one or more embodiments or examples.

The terms "comprises", "comprising", "includes", "including", "has", "having", "could", "could have" or their grammatical equivalents, are used in this Specification to mean that other features, components, materials, steps, etc. are optionally present as a non-exclusive inclusion. For instance, a device "comprising" (or "which comprises") components A, B, and C can contain only components A, B, and C, or can contain not only components A, B, and C but also one or more other components. For example, a method comprising two or more defined steps can be carried out in any order or simultaneously, unless the context excludes that possibility; and the method can include one or more other steps which are carried out before any of the defined steps, between two of the defined steps, or after all the defined steps, unless the context excludes that possibility.

Further, unless expressly stated to the contrary, "or" refers to an inclusive or and not to an exclusive or. For example, An embodiment could have optional features A, B, or C, so the embodiment could be satisfied with A in one instance, with B in another instance, and with C in a third instance, and probably with AB, AC, BC, or ABC if the context of features does not exclude that possibility.

Examples or illustrations given are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these example or illustrations are utilized will encompass other embodiments, which may or may not be given in this Specification, and all such embodiments are intended to be included within the scope of that term or terms. Language designating such nonlimiting examples and illustrations includes, but is not limited to "for example", "for instance", "etc.", "or otherwise", and "in one embodiment."

The phrase "at least" followed by a number is used to denote the start of a range beginning with that number, which may or may not be a range having an upper limit, depending on the variable defined. For instance, "at least 1" means 1 or more.

In this specification, "a" and "an" and similar phrases are to be interpreted as "at least one" and "one or more." In this specification, the term "may" or "can be" or "could be" is to be interpreted as "may, for example." In other words, the term "may" is indicative that the phrase following the term "may" is an example of one of a multitude of suitable possibilities that may, or may not, be employed to one or more of the various embodiments.

The phrase "a plurality of" followed by a feature, component, or structure is used to mean more than one, specifically including a great many, relative to the context of the component. For example, "a plurality of modules" means more than one, and specifically includes more than a few and at least one embodiment of the invention includes hundreds of modules on one modular assembly.

It is the applicant's intent that only claims that include the express language "means for" or "step for" be interpreted under 35 U.S.C. § 112. Claims that do not expressly include the phrase "means for" or "step for" are not to be interpreted under 35 U.S.C. § 112.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purpose required by law, but otherwise reserves all copyright rights whatsoever.

FIG. 1 is a top perspective illustration of an embodiment of a modular assembly 300 in the form of a possible configuration according to one embodiment, where at least two modules 200 are arranged next to each other. Each of these modules 200 has a first side 210 with a top surface 220 (no textured surfaces have been shown in this embodiment for simplicity) and at least three edge sides 240. Some edge sides include coupler notches 242 in certain embodiments. It also shows a variety of vertical structures 320 which can be added to the modules 200, to create rooms with walls, transitions to raised planes of play, and other game related structures within the modular assembly 300, like a door 322, a wall 324, and a stair assembly 326. Furthermore, FIG. 1 illustrates a possible embodiment of a raised plane of some of the modules 200 by elevators 310 following a stair assembly 326, which is a type of vertical structure 320. Having a few modules of a raised plane can add depth and variety to a map assembly, and the enjoyment of a user.

Figure 2:
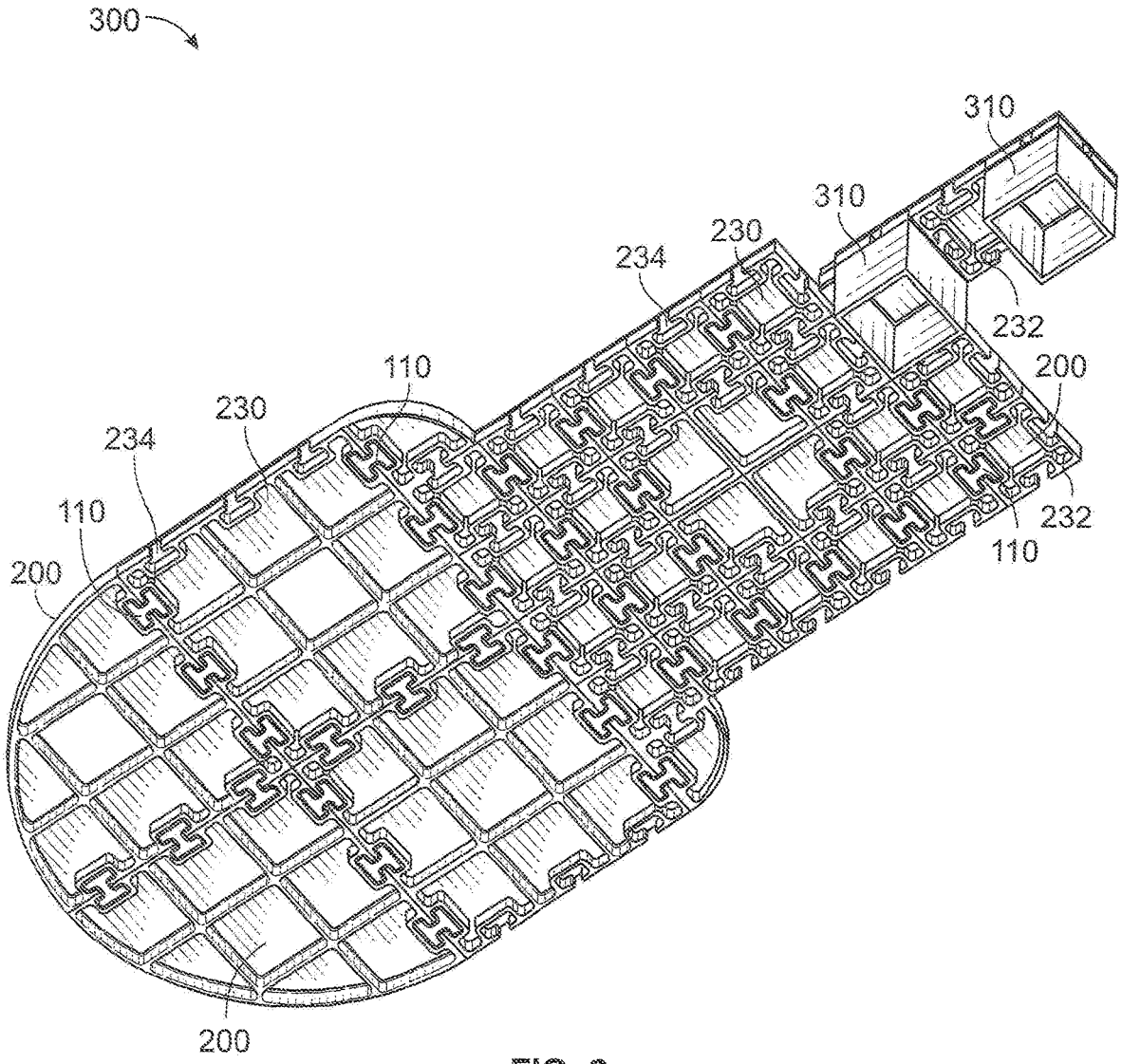
FIG. 2 is a bottom perspective illustration of an embodiment of a modular assembly similar to FIG. 1, showing a possible variety of modules connected by couplers and utilizing various vertical structures and elevators to create a possible configuration of an embodiment of the invention.

FIG. 2 is a bottom perspective illustration of an embodiment a modular assembly 300, similar to FIG. 1, but showing the second side 230 of the modules 200, adjoined together by couplers 110 that are substantially "H"-shaped, at the coupler pockets 234. It also shows the lug pockets 232 on the bottom of the corner modules 200 and elevators 310 creating a raised plane of connected modules 200.

Figure 3:
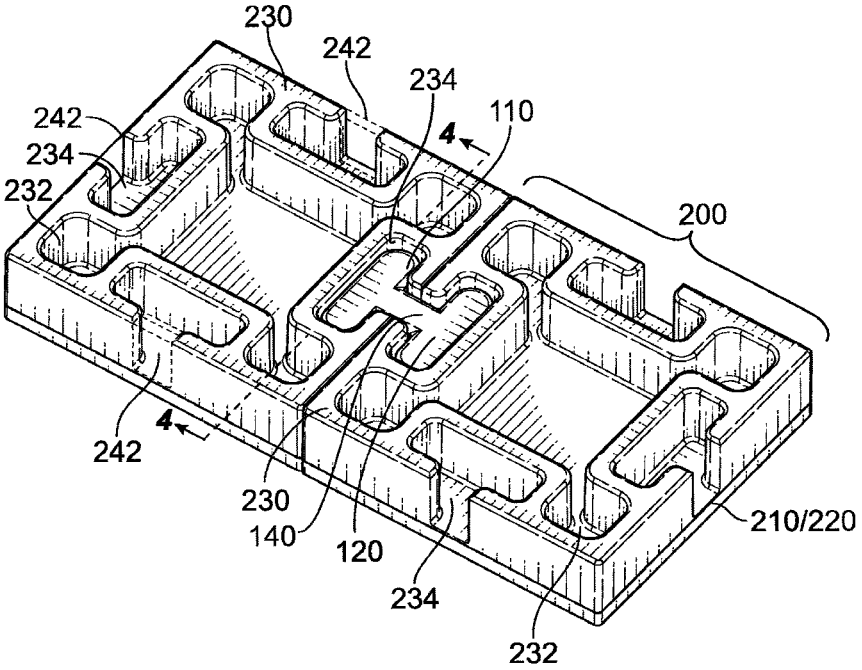
FIG. 3 is a bottom perspective illustration of a possible embodiment of two, four-sided modules in a position on the adjacent edge sides of the modules with a possible embodiment of a coupler fit into two adjacent coupler pockets in the modules, and a dashed-line indicating the cross-section line of FIG. 4.

FIG. 3 is a bottom perspective illustration of a possible embodiment of two modules 200, showing the second side 230 of two modules 200 are adjoined together by substantially "H"-shaped coupler 110 with substantially oblong-shaped coupler heads 120 connected by a single coupler neck 140. The embodied example of FIG. 3 shows the two substantially oblong-shaped coupler head 120 of the coupler 130 fit into the coupler pocket 234 of two adjacent modules 200, while the coupler neck 140 fits into the coupler notches 242 in the edge sides of the modules 200. In this embodiment, there is also lug pockets 232 on the corners of each module 200. The top surface 220 of the first side 210 can be seen behind the second side 230 of the module 200. The arrowed and dashed line indicated as "4" through one of the coupler heads fit into a coupler pocket is to indicate the cross section similar to FIG. 4.

Figure 4:
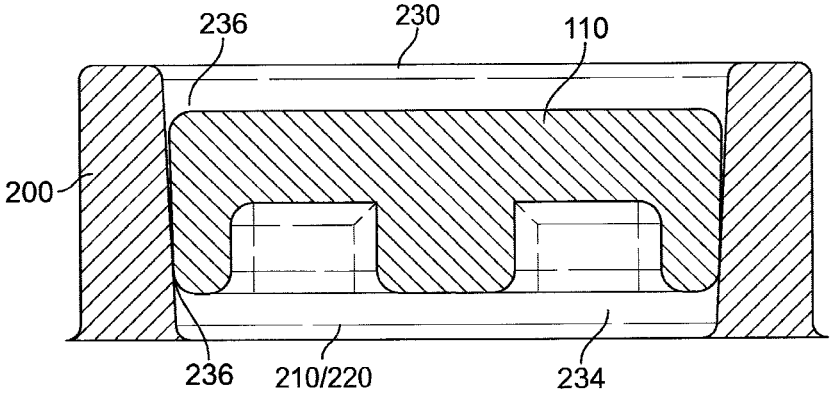
FIG. 4 is a cross section of a possible embodiment of the invention showing the tapered coupler fit by the coupler and coupler pockets and coupler notches of the modules, similar to that shown in FIG. 3.

FIG. 4 is a cross-sectional illustration of an embodiment of the invention showing the space of the coupler pocket 234 of a module 200 with a coupler 110 fitting into the coupler pocket 234 and forming a tapered coupler fit 236. The top surface 220 of the first side 210 of the module 200 can be seen oriented toward the bottom of the page, and the second side 230 can be seen oriented toward the top of the page from the first side 210 in this embodiment. The walls of the coupler pocket 234 of the module 200 slightly increase in thickness, with the thickest part of the coupler pocket 234 being toward the first side 210 in this embodiment, which creates the tapered coupler fit 236. Other embodiments could just as easily be reversed, in that the thickness resides towards the outer edge of the second side 230, with the first side having openings through which to press the coupler 110 into the coupler pocket 234.

Figure 5:
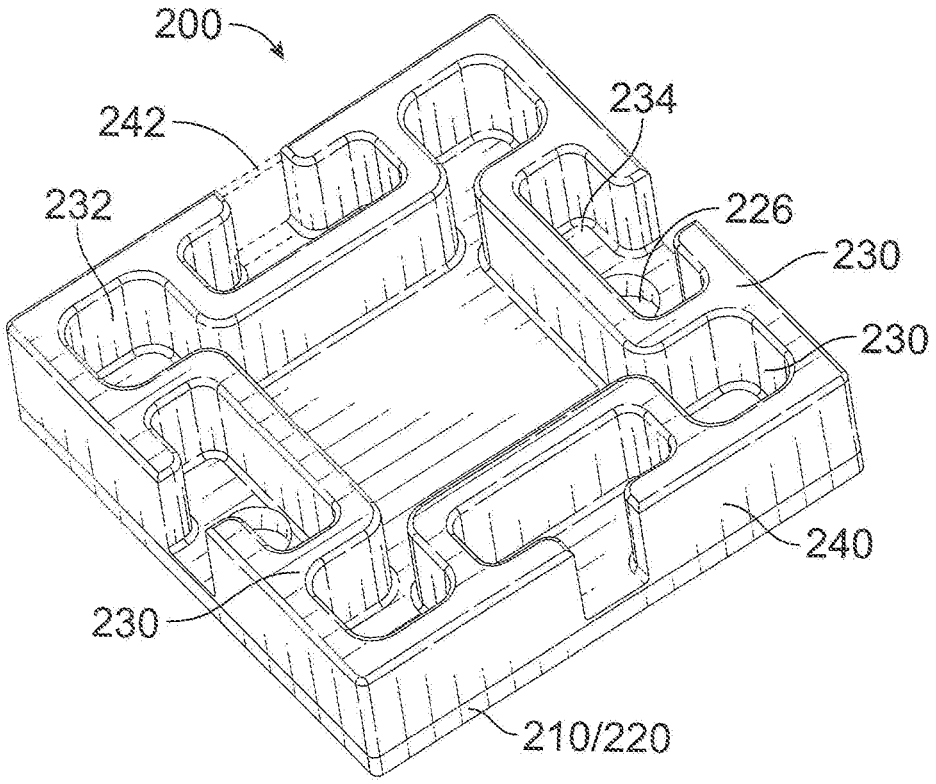
FIG. 5 is a bottom perspective view of an embodiment of a module showing the second side of the module, including mounting holes, coupler notch, and lug pockets.

FIG. 5 is a bottom perspective view of an embodiment of a module 200 of the invention showing the second side 230 of the module with the top surface 220 of the first side 210 being underneath the second side 230, the edge sides 240 of the module being around the perimeter of the module 200 and between the first side 210 and the second side 230, and including mounting holes 226, lug pockets 232, coupler pockets 234, and coupler notches 242.

Figure 6:
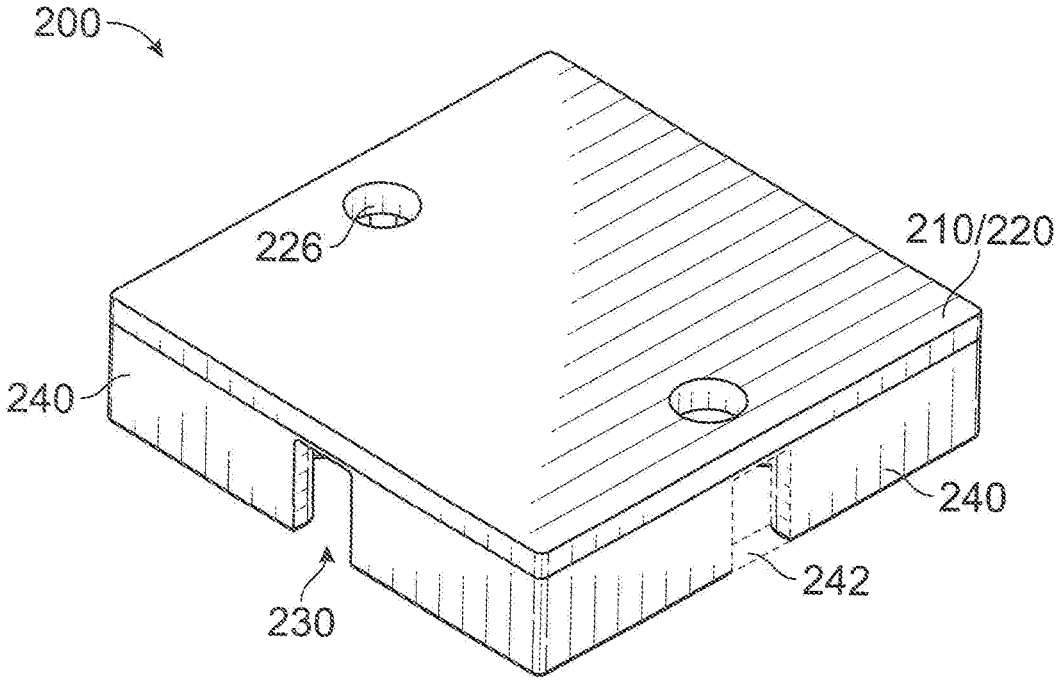
FIG. 6 is a top perspective view of a possible embodiment of a modular similar to the embodiment in FIG. 5, showing the first side of the module with mounting holes on the top surface, and an edge side of the module with a coupler notch.

FIG. 6 is a top perspective view of an embodiment of the module 200 of the invention showing the first side 210 with mounting holes 226 on the top surface 220, coupler notches 242 on the edge sides 240 and second side 230 of the module 200 being inside and under the given perspective.

Figure 7:
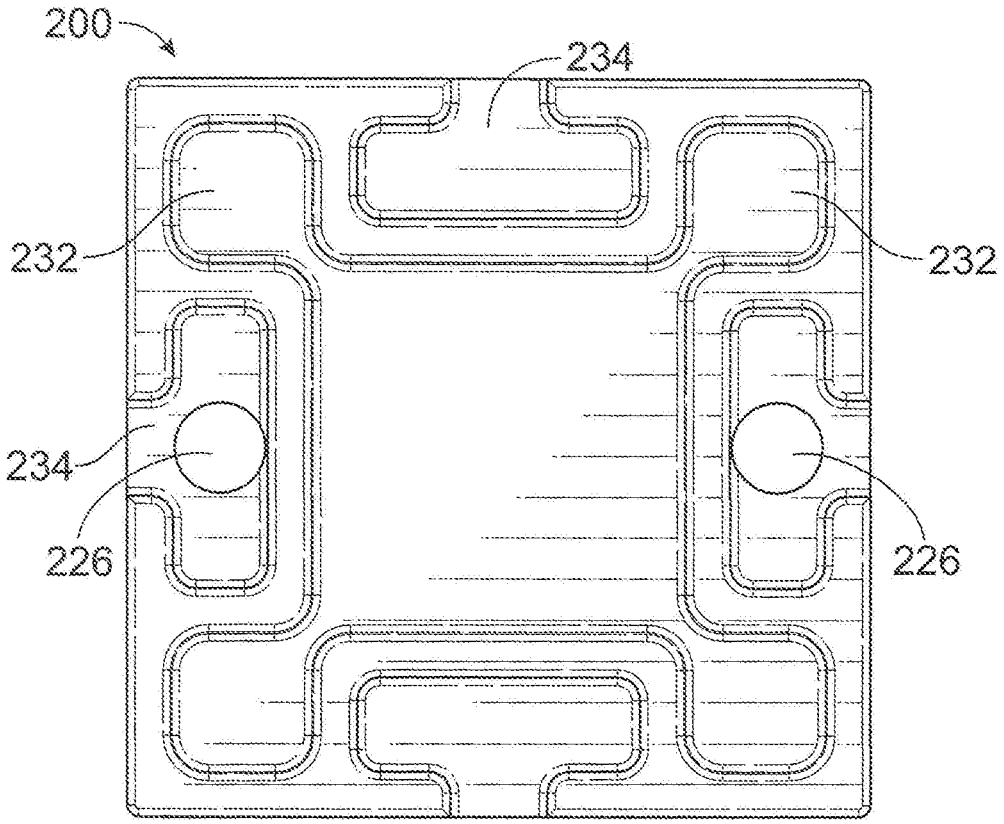
FIG. 7 is a bottom view of a possible embodiment of a module, showing the second side of the module, including coupler pockets, lug pockets.

FIG. 7 is a side view of an embodiment of the module 200 of the invention, showing the mounting holes 226, lug pockets 232, and coupler pockets 234.

Figure 8:
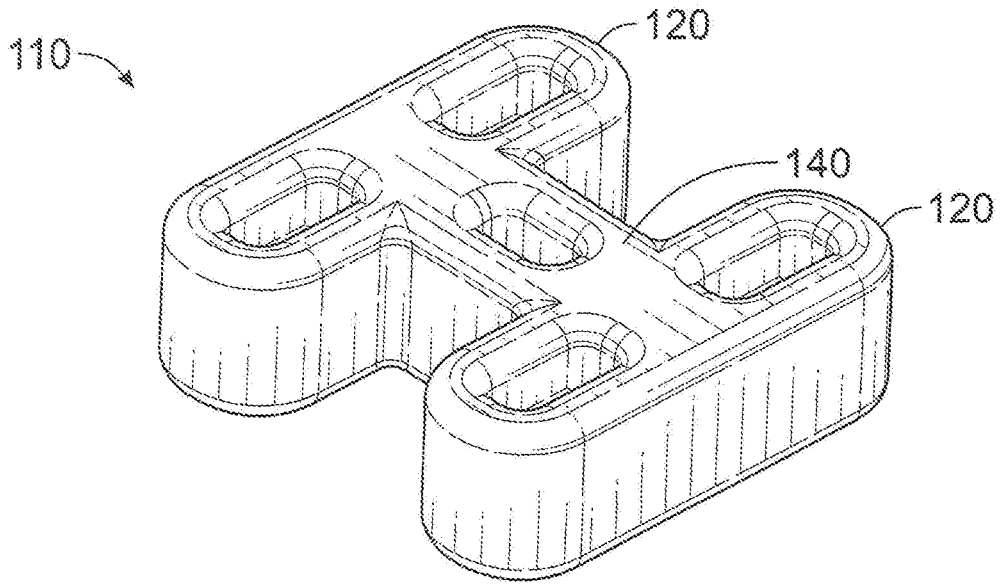
FIG. 8 is one side view of a possible embodiment of the coupler in the invention showing a H-shaped coupler, with material saving spaces, two substantially oblong shaped coupler heads, and a coupler neck.

FIG. 8 is a side perspective view of an embodiment of the coupler 110, showing the coupler 110 in a nearly horizontal position, with two coupler heads 120 connected by a single coupler neck 140. A person skilled in the art would appreciate that the coupler has plastic saving spaces on this side, as would be common in the industry.

Figure 9:
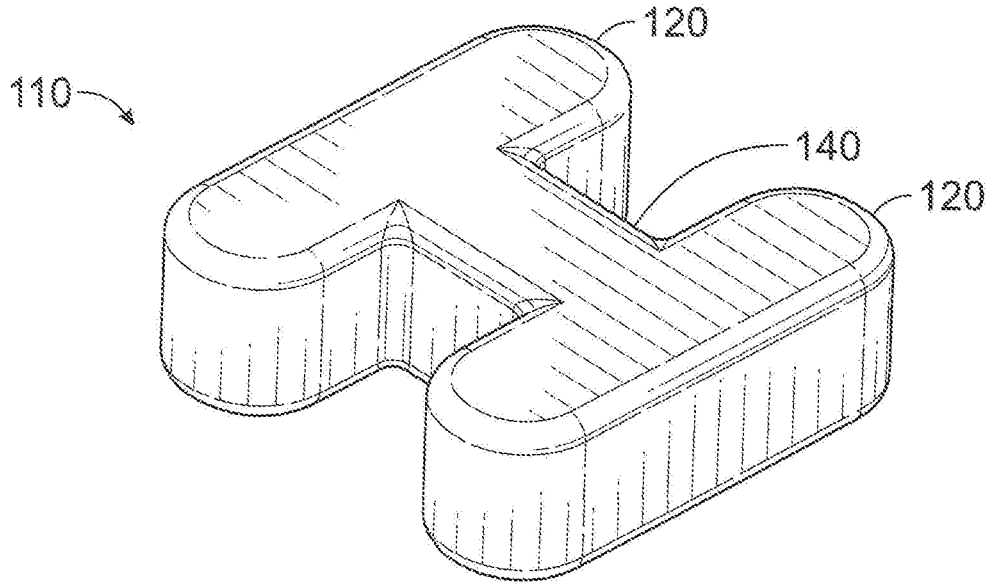
FIG. 9 is an opposite side perspective view of a possible embodiment of the coupler in the invention similar to FIG. 8, showing a H-shaped coupler, including two coupler heads and a coupler neck.

FIG. 9 is an opposite side perspective view of an embodiment of the coupler 110 similar to the coupler of FIG. 8, in a nearly horizontal position, with two coupler heads 120 connected by a single coupler neck 140.

Figure 10:
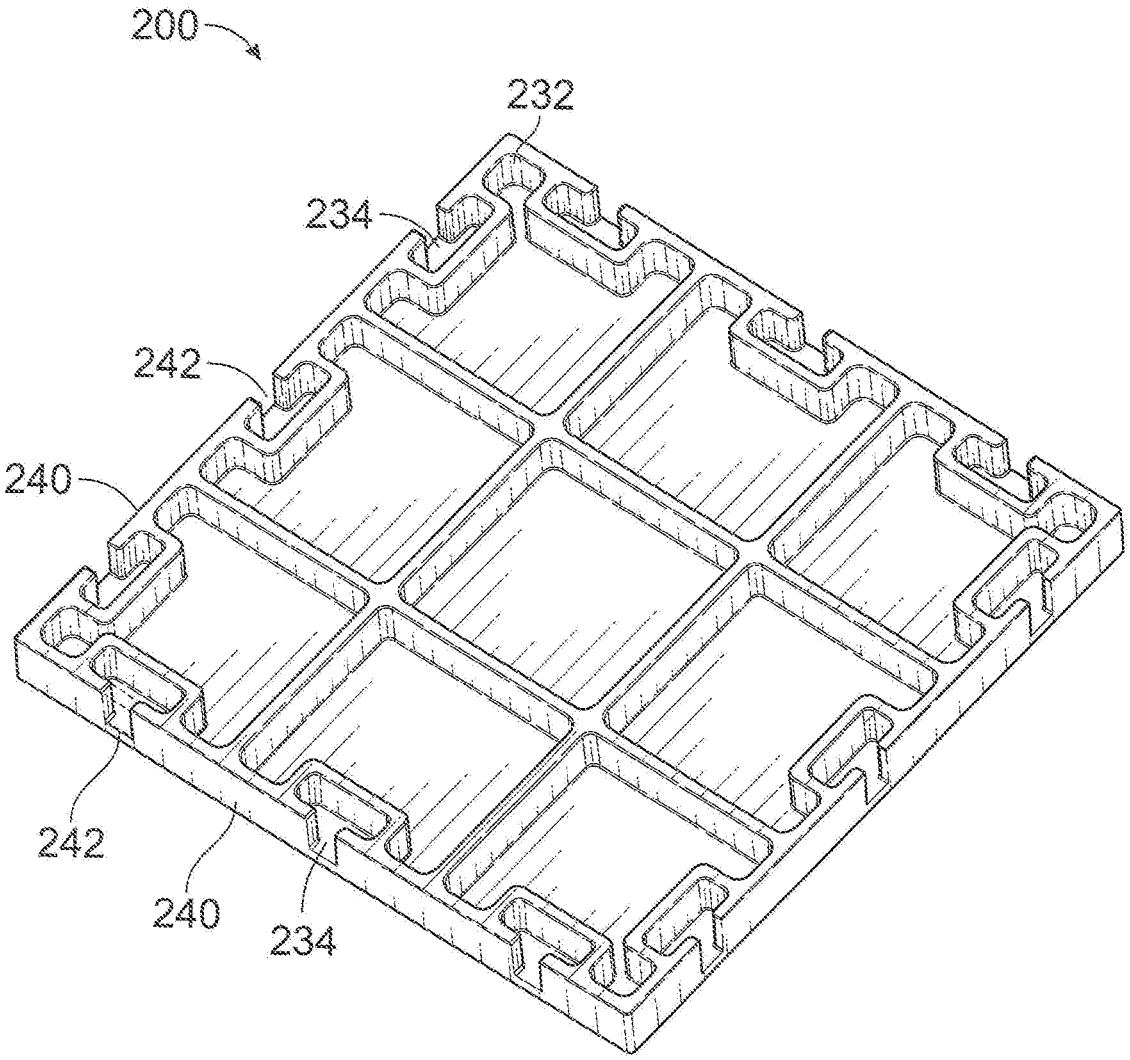
FIG. 10 is a bottom perspective view of a possible embodiment of the module of the invention that contains three coupler pockets on each edge side, as a larger module as compared to FIG. 5 if used together in a modular assembly.

FIG. 10 is a perspective view of a larger embodiment of the module 200 of the invention, specifically, a relatively larger module that contains lug pockets 232 on the corners, three coupler pockets 234 and three corresponding coupler notches 242 on each of the four edge sides 240. Larger modules, as depicted in this figure, allow a user to use a single module to cover several smaller module's surface area in a more convenient fashion in a modular assembly, like nine modules-worth of surface area.

Figure 11:
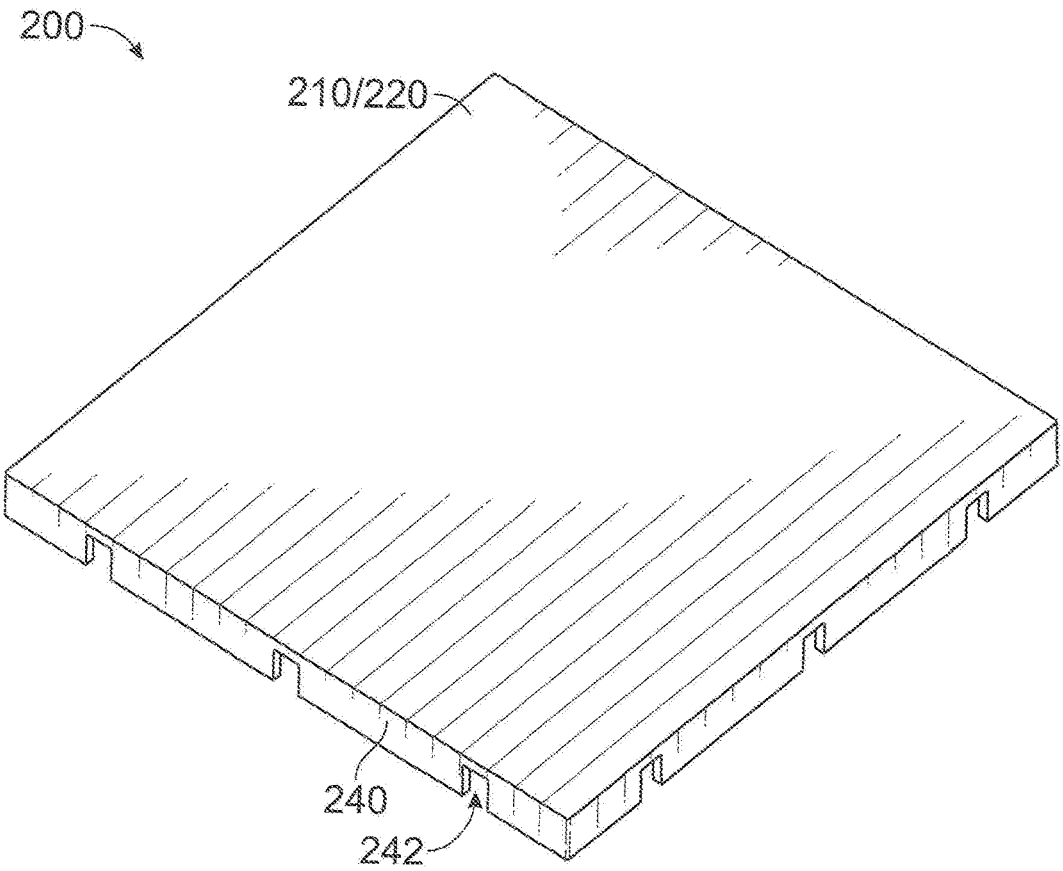
FIG. 11 is a top perspective view of a possible embodiment of the module of the invention similar to FIG. 10, showing the top surface of the first side and two edge sides with three coupler notches on each edge side.

FIG. 11 is a top perspective view of an embodiment of the module 200 of the invention similar to FIG. 10, showing the top surface 220 of the first side 210 of a specifically larger module 200 containing three coupler notches 242 on the edge sides 240. This embodiment does not show a textured design or mounting holes, but those could easily be included in other embodiments of the invention.

Figure 12:
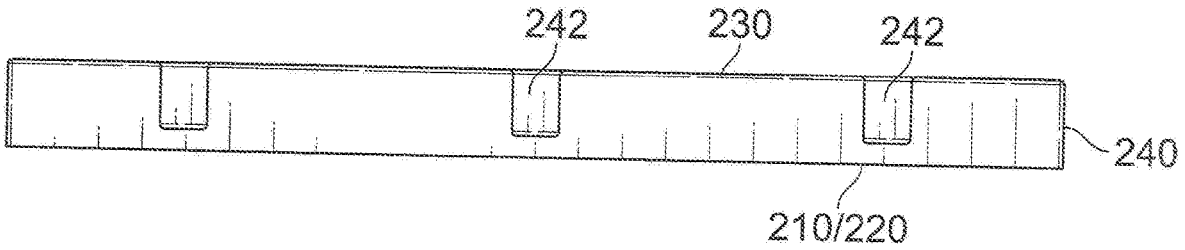
FIG. 12 is a side view of a possible embodiment of the module of the invention similar to FIG. 11, showing an edge side of the module with three coupler notches, the module oriented to have the top surface/first side to be towards the bottom of the page.

FIG. 12 is a side view of an embodiment of the module of the invention similar to FIG. 10 and FIG. 11, showing the edge sides 240 with coupler notches 242 and the top surface 220 of the first side 210 and the second side 230.

Figure 13:
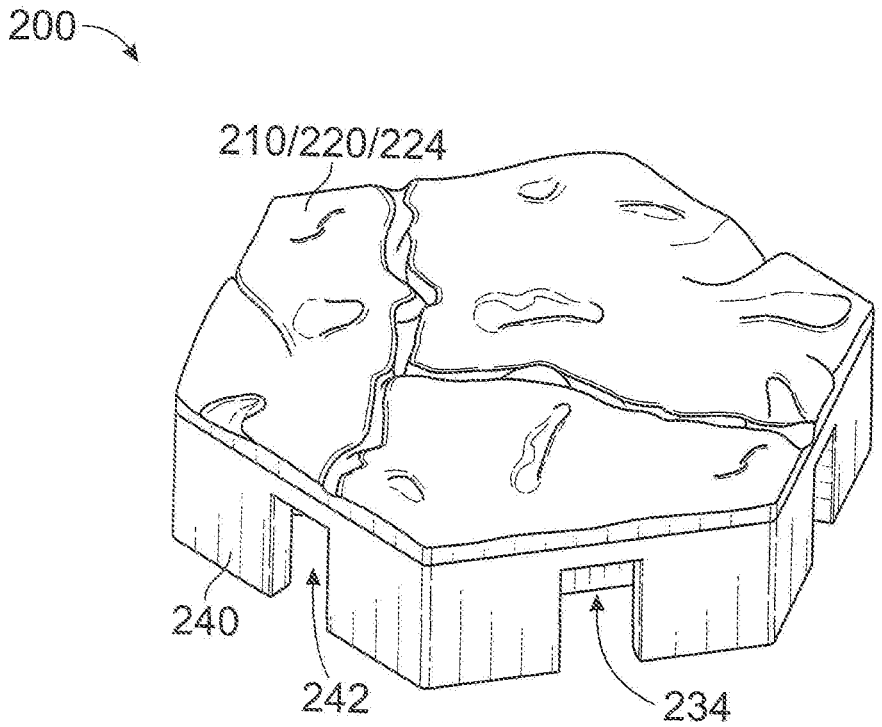
FIG. 13 is a top perspective view of a possible embodiment of the module of the invention showing a textured design of the top surface of the first side of a module with six edge sides and one coupler notch on each edge side.

FIG. 13 is a top perspective view of an embodiment of the invention showing a hexagonally shaped module 200, where the top surface 220 of the first side 210 has a textured design 224, perhaps to simulate an unhewn stone floor, the edge sides 240 have coupler notches 242, and coupler pockets 234 are on the other side of the coupler notches 242.

Figure 14:
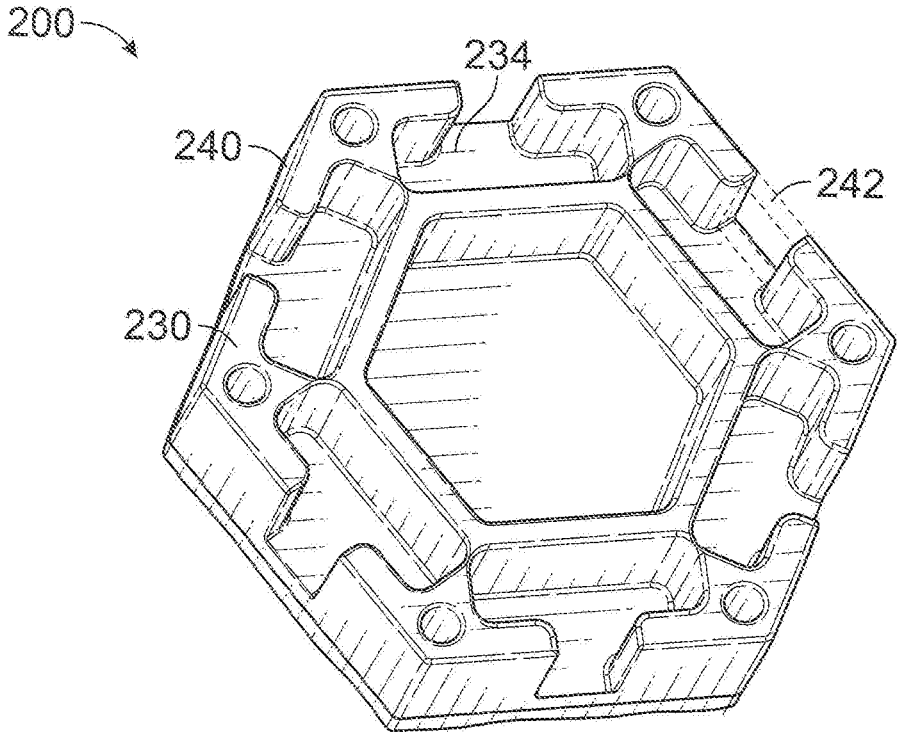
FIG. 14 is a bottom perspective view of a possible embodiment of the module of the invention similar to FIG. 13, showing the second side of a module with six edge sides and one coupler pocket on each edge side.

FIG. 14 is a bottom perspective view of an embodiment of the invention similar to FIG. 13, showing a hexagonally shaped module 200, where the second side 230 has coupler pockets 234, and the edge sides 240 have coupler notches 242.

Figure 15:
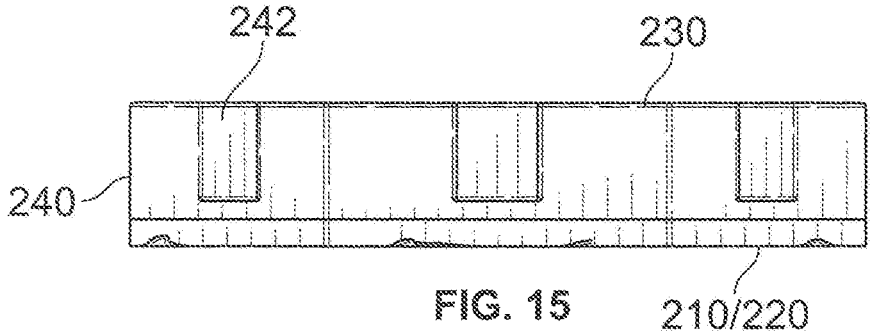
FIG. 15 is a side view of a possible embodiment of the module of the invention similar to FIG. 14, showing a textured design of the top surface of the first side of module with three edge sides and one coupler notch on each edge side.

FIG. 15 is a side view of an embodiment of the module of the invention similar to FIGS. 13 and 14, showing the edge sides 240 containing coupler notches 242 and the top surface 220 of the first side 210 and the second side 230.

Figure 16:
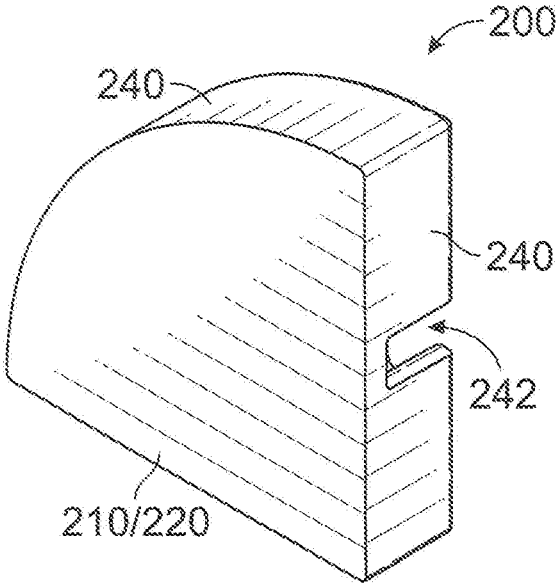
FIG. 16 is a top-side perspective view of a possible embodiment of the module of the invention showing a module with three sides.

FIG. 16 is a top-side perspective view of embodiment of the module 200 of the invention showing the first side 210 top surface 220, and the coupler notches 242 on two of the three edge sides 240 of the module 200.

Figure 17:
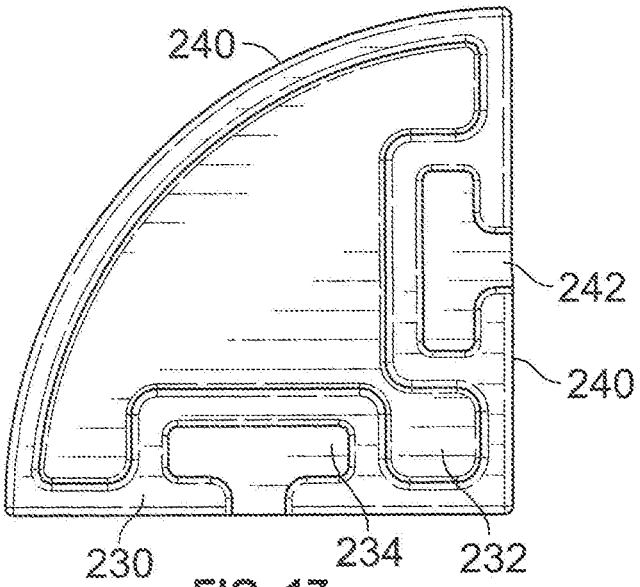
FIG. 17 is a bottom view of a possible embodiment of the module of the invention, showing the second side of a module with three edge sides and two coupler pockets. Only two of the edge sides have coupler notches and coupler pockets. It also shows the lug pockets, coupler pockets, and coupler notches on the edge sides of the module.

FIG. 17 is a bottom view of an embodiment of module of the invention similar to FIG. 16, showing the second side 230 with a coupler pocket 234, lug pocket 232, and three edge sides 240, where two of the edge sides 240 contain coupler notches 242.

Figure 18:
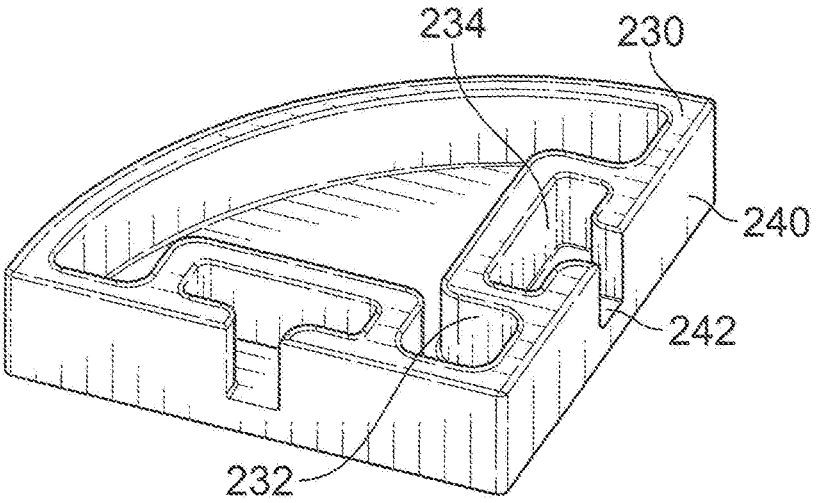
FIG. 18 is a bottom perspective view of a possible embodiment of the module of the invention, showing the second side of a module with three edge sides.

FIG. 18 is a bottom perspective view of an embodiment of the module of the invention similar to FIG. 16 and FIG. 17, showing the second side 230 with coupler pocket 234, lug pocket 232 and three edge sides 240 where two edge sides 240 each contain a coupler notch 242.

Figure 19:
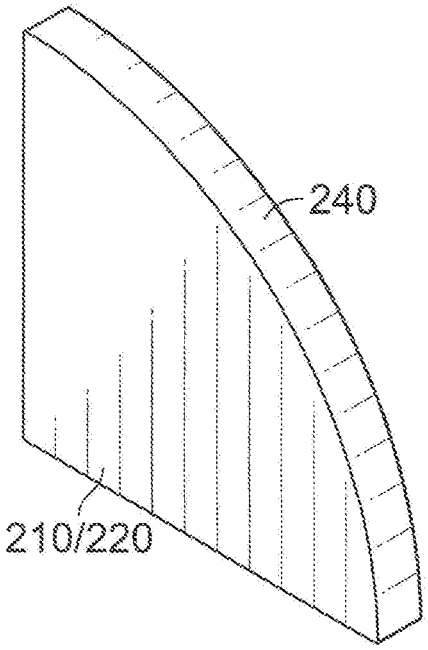
FIG. 19 is a top perspective view of an embodiment of the module of the invention, showing the top surface on the first side of a module with three edge sides and one edge side has no coupler notch.

FIG. 19 is a top perspective view of an embodiment of the module of the invention showing the first side 210 top surface 220 and the edge side 240.

Figure 20:
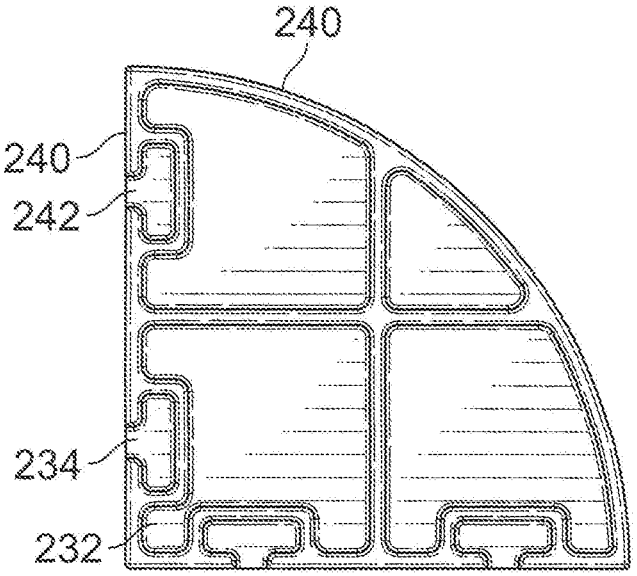
FIG. 20 is a bottom view of an embodiment of the module of the invention, showing the second side of the module with three edge sides. Two of the edge sides have two coupler pockets each, and one side has no coupler pockets. It also shows the coupler notches on the edge sides, tapered coupler pockets, and lug pockets.

FIG. 20 is a bottom view of an embodiment of the module of the invention showing the second side containing lug pockets 232, three edge sides 240, two of the edge sides 240 have two coupler pockets 234 each and corresponding coupler notches 242.

Figure 21:
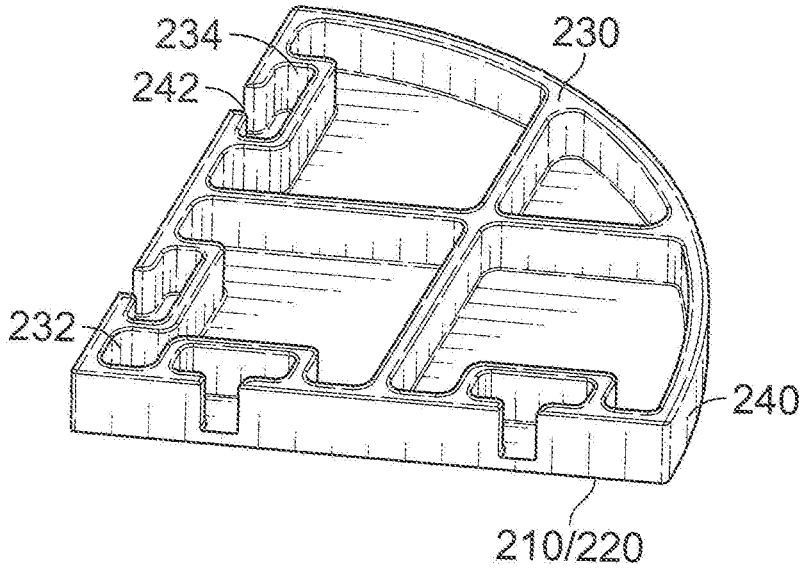
FIG. 21 is a bottom perspective view of an embodiment of the module of the invention, showing the second side of a module with three edge sides similar to the embodiment of FIG. 4.

FIG. 21 is a bottom perspective view of an embodiment of the module of the invention similar to FIG. 20, showing the first side 210, top surface 220, the second side 230, with the coupler pockets 234, lug pockets 232, and three edge sides 240, two of which contain coupler notches 242.

Figure 22:
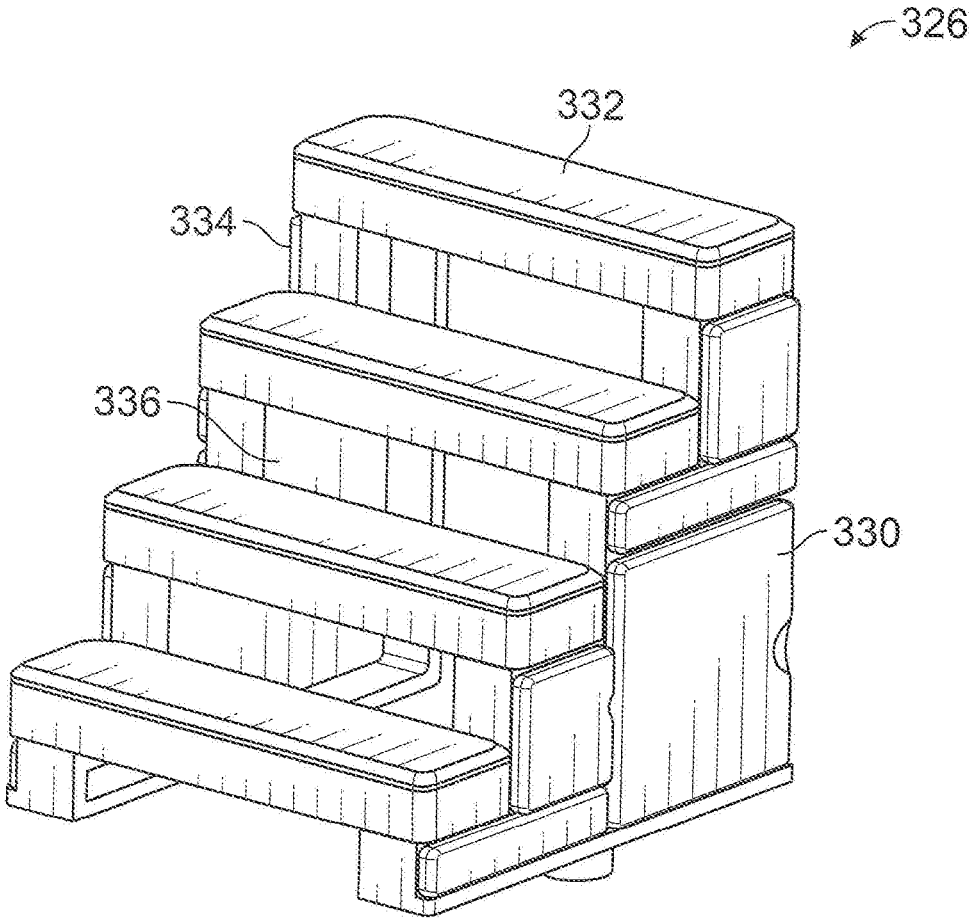
FIG. 22 is a front perspective view of an embodiment of the stair assembly of the invention, which is a vertical structure, including the stair stringers, tread connectors, open stair riser, and the tuck-in space between two tread connectors, which can accommodate a gaming base edge.

FIG. 22 is a front perspective view of the embodiment of the stair assembly of the vertical structures of the invention showing the stair assembly 326 with a stair stringer 330, a tread connector 332, an open stair riser 334, and a tuck-in space 336 which is configured to accommodate a gaming base edge. This embodiment of the stair assembly also shows possible textured designs, which may be added to match the theme of a particular modular assembly set.

Figure 23:
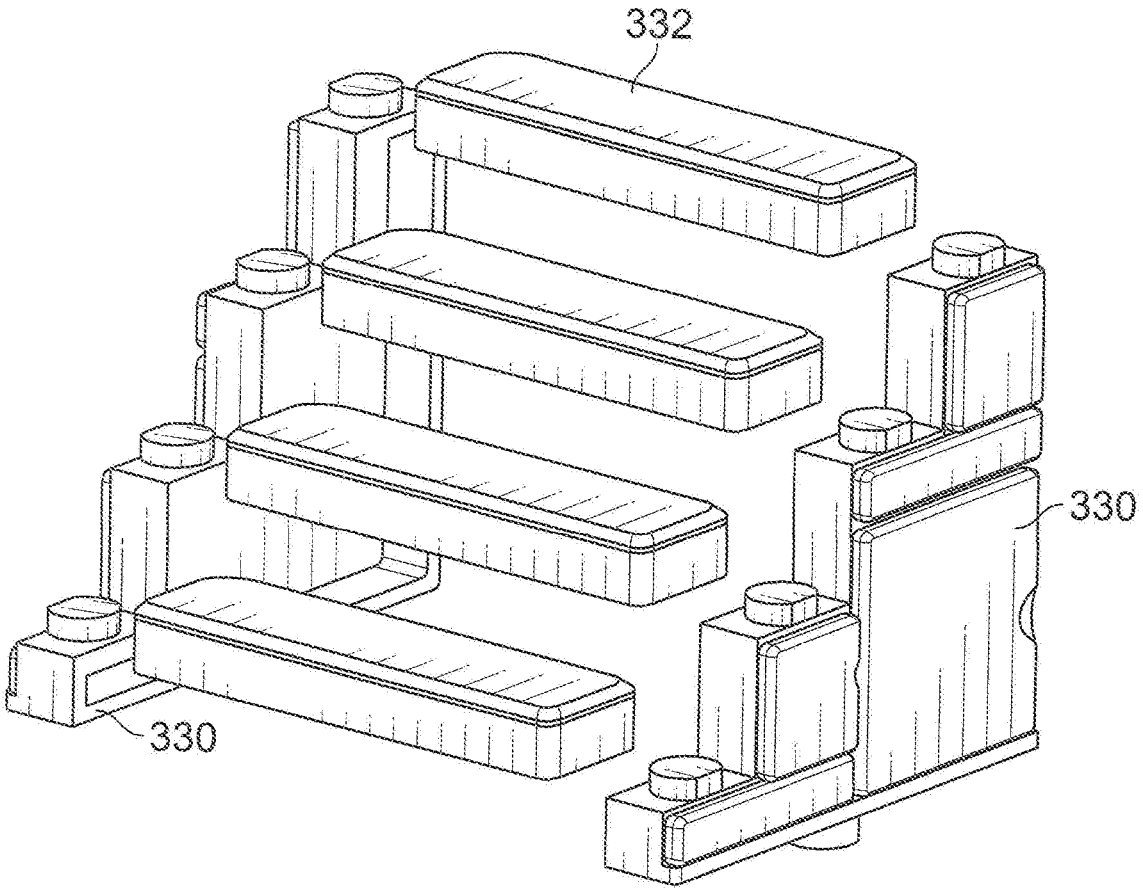
FIG. 23 is an exploded view of an embodiment of the stair assembly, showing the relationship between different parts of the stair assembly, including stair stringers and tread connectors.

FIG. 23 is an exploded view of the stair assembly of an embodiment of the invention, showing the relationship between different parts of the stair assembly, including the stair stringer 330 and tread connectors 332.

Figure 24:
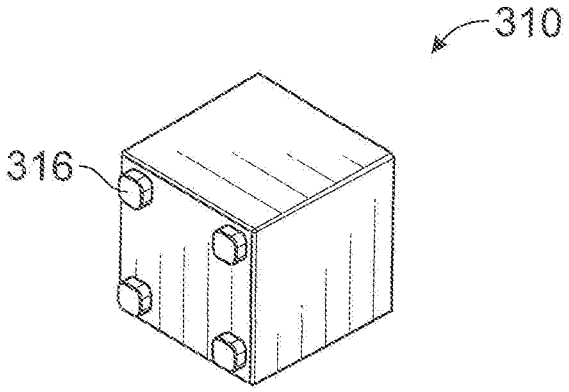
FIG. 24 is a front perspective view of an embodiment of the elevator of the invention, showing the elevator's lugs whereby a module could attach the lug to its lug pockets to create an elevated level.

FIG. 24 is front perspective view of a possible embodiment of the elevator of the invention, showing the elevator 310 with lugs 316 whereby a module could attach the lug into its lug pocket to create a raised plane to the modular assembly.

Figure 25:
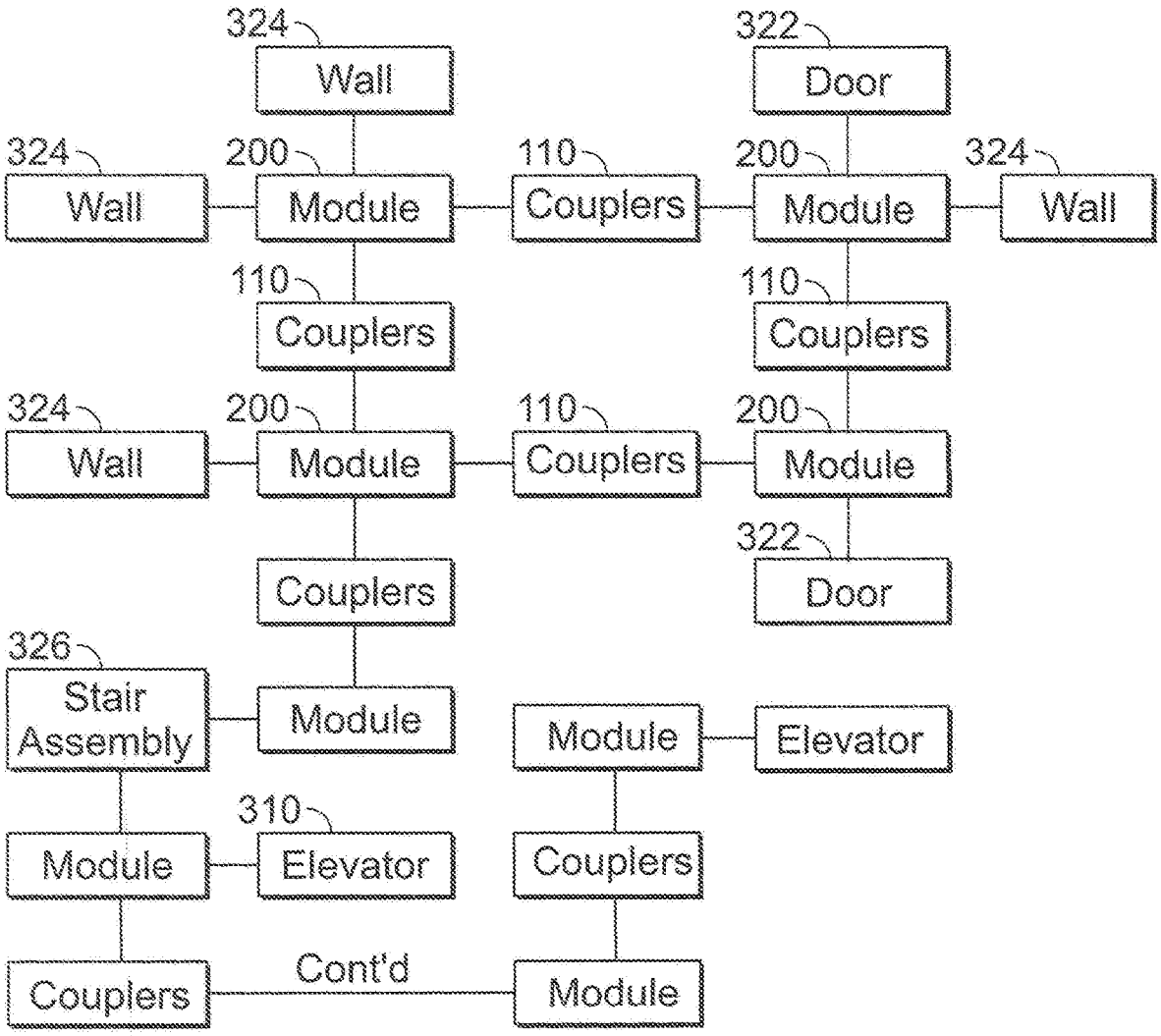
FIG. 25 is a block diagram, illustrating more basic embodiments of a modular assembly.

FIG. 25 is a block diagram of an embodiment of a modular assembly 300 of the invention, showing five (5) modules 200 connected by couplers 110, forming a modular assembly 300 with walls 324 and doors 322, the fifth module 200 being attached to a stair assembly 326 which leads to an raised plane of three modules 200 with an elevator 310 to hold the modules 200 at the elevated level on the raised plane.

Figure 26:
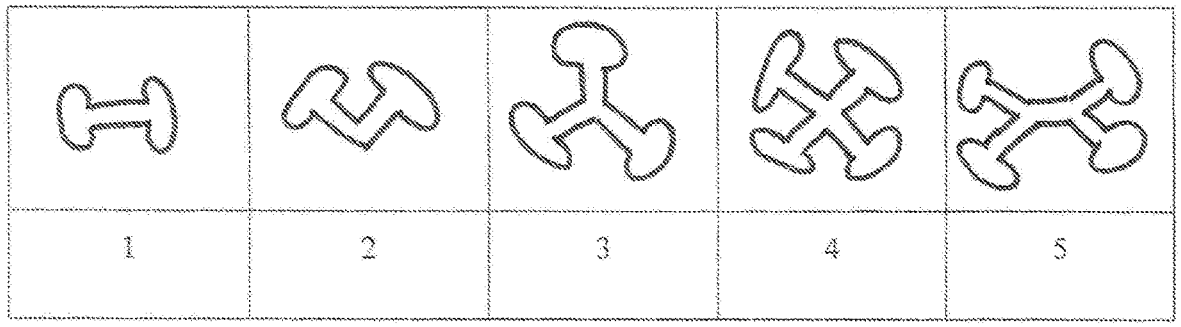
FIG. 26 is a top perspective view of various embodiments of a coupler neck relative to the number of coupler heads.

FIG. 26 is a top-perspective view of various embodiments of a coupler neck 140, showing a variety of portions or sizes relative to the number of coupler heads 120 in a coupler 110.

coupler 110 means a component of the invention that is capable of joining two modules by their adjacently oriented sides. The purpose of the coupler is to connect modules together to form a map assembly of modules and optional accessories. This connection between the modules and the coupler, in the embodiments of the invention, is made when the coupler is at a parallel plane to the first side/top surface, pressed into the coupler pocket from the second side of the modules, where the coupler heads each secure the adjacently-oriented edge-sides of the modules, to create a plane of modules. Though, the coupler could also be received into the coupler pocket through the first side of the module, in some embodiments of the invention. Additionally, while the figures show embodiments of individual couplers, which increases transportability for the user, the embodiments of the invention would also include sheets of couplers, arranged at the appropriate intervals for the particular modular assembly and a user could press the modules into the sheet of couplers. The coupler, in embodiments of the invention, comprise at least two coupler heads, and the at least two coupler heads are connected by at least one coupler neck, as defined in this description. The coupler's surface could be a variety of textures, as long as the parts of the coupler that fit into the coupler pockets can do so. There could be bumps, ridges, lines, engravings, or other features/surfaces, like smooth, rough, patterned, or slick, as long as the invention is operable. The coupler must have at least two coupler heads, in order to join at least one module to another. There are some embodiments where three, five, six, or more sided modules could have intersecting points that accommodate and are coupled by couplers with three, five, six, or more coupler heads. For example, if six-sided (hexagonal) modules were used, three modules would form a three-pointed intersection point between the three of them, with each module having an adjacent edge-side with each of the other modules; the coupler for such an embodiment/configuration could be a three-headed coupler to be pressed into the edge-sides to secure three modules together at that point, or two-headed couplers could be inserted at the adjacent edge-sides, as depicted in FIG. 14. It would be clear to one skilled in the art of the practical advantages of using the two-headed coupler as depicted in the figure embodiments with both a four-sided module assembly and a six-sided module assembly, to simplify collection by a consumer who had interest in using both a 'square' map assembly and a 'hexagon' map assembly and wanted the couplers to be interchangeable and useable with either assembly. The materials for a coupler are limited to solid materials that are safe for human handling, and conducive to the general wear and tear of use. Ideal materials are often selected from a combination of many factors, including expense, durability, production/craft time, weight, customer preference, and others. Various plastics are a clear choice, but the embodiments of the invention could also be various woods, stone or other minerals, silicon, metals, and even heavy paper or composites or cardboard. The terms "top" or "bottom" to describe the couplers orientation in the drawings should not be taken to heart to comprise any such limitations only to ease the explanation of the coupler structure. When a coupler structure is made, it would be clear to a person skilled in the art that material saving spaces are a good way to save materials and commonly utilized in manufacturing. The size of a coupler is dependent on the modular assembly size and scale. Color of the coupler is immaterial to the embodiments of the invention, though there may be preferences based on branding, customer preference, ease of distinction, and others.

coupler head 120 (at least two/two) means the ends of the coupler that are connected by at least one coupler neck. If there are two coupler heads, they may be oriented in different angles in embodiments of the invention, but for commercial simplicity and unity of the assembly, oppositely oriented coupler heads are depicted in embodiments of the invention in the drawings. The shape of the coupler heads could be varied as long as it is of a sufficient thickness to create some sort of fit into the coupler pocket of the second side, and safe for human handling. A person skilled in the art would appreciate that thin sheets of paper, for example, would not work because there would be insufficient infrastructure to secure a coupler in coupler pockets of modules. Additionally, sharp edges or points capable of puncturing skin would also not be ideal for practical use. Coupler heads could be a variety of shapes, even one from another on the same coupler, but one skilled in the art would appreciate the practical and economic considerations of having couplers with uniform coupler heads to fit uniform coupler pockets in modules. The variety of shapes could be cuboidal, rectangular, various types of prisms, cylindrical, conical, spheroid, or other shapes so long as it can be pressed or fitted into a correspondingly shaped coupler pocket.

substantially oblong-shaped (oppositely arranged and connected by one coupler neck) means discorectangle, obround, stadium, or sausage body-shaped coupler heads which are arranged oppositely each other on the coupler with one coupler neck connecting the two coupler heads together. Embodiments with this feature are depicted in the FIGS. 8 and 9, but other proportions between coupler heads and coupler necks are included in the scope of the claims. For example, coupler heads could be larger or smaller relative to the coupler neck, and the variables available in the embodiments of the coupler neck could also change the dimensions in various embodiments of the coupler.

coupler neck 140 (at least one/one) means the part of the coupler that is not the coupler head but connects the coupler heads together. For purposes of this specification, in describing the number of coupler necks in a coupler, See, FIG. 26. Coupler necks can be of a variety of proportions or sizes relative to the coupler heads. The limitations on size of the coupler necks are related to functionality. In some embodiments, perhaps even something as thin as a string or cable or strip would connect two coupler heads; while in other embodiments, a coupler neck may be relatively thick and substantial, as seen in FIGS. 8 & 9. If the couplers are made of plastic or silicon, for instance, a coupler neck will need to be of sufficient thickness to withstand general use. The length of coupler necks must accommodate the thickness of the edge sides of the modules, and a person skilled in the art would appreciate that a coupler neck might be designed to fit the needs of a large module's edge sides and that having the same coupler fit and edge side thickness in other module sizes in the same assembly would be advantageous for consistency and ease of the user. The shape of the coupler neck has few limitations, and could be rounded, edged, and have bumps or ridges.

substantially "H"-shaped means a further limitation of a coupler with a shaped coupler heads, where the shape of the coupler overall could be described as "H" or "I" shaped. The coupler heads in this limitation are of similar length parallel to each other, with the coupler neck perpendicular and oriented at the midpoint of the length of the coupler heads.

module 200 (at least two) means the chief component of the modular assembly map that creates the "floor" or "surface" of the map. Each module has a first side with a top surface with a top surface, the first side is opposite a second side, and the first side and the second side are connected by at least three edge sides. These features are further defined below. Mounting holes can be added to the modules to attach vertical structures such as: stairs, door, walls, cave features, or other simulated terrain. When the claims refer to at least one of the modules in relation to attaching vertical structure the decision of how many walls, doors, stairs etc., to include in a given configuration of the modular assembly is user-determined based on their needs at the time, or the map then wish to create/simulate. The module is available in several sizes and shapes, it is up to the imagination of the user to arrange modules into particular configurations for the needs of their game or purpose. Of key import of concept of the module in this invention is that it is comprised of intentionally separable components, interchangeable with others; for assembly into units of different size, complexity or function. FIGS. 1 and 2, for example, show embodiments of the invention utilizing a variety of modules in both relative size and shape and number of sides. The materials for modules are limited to solid materials that are safe for human handling, and conducive to the general wear and tear of use. Ideal materials are often selected from a combination of many factors, including expense, durability, production/craft time, weight, customer preference, and others. Various plastics are a clear choice, but the embodiments of the invention could also be various woods, stone or other minerals, silicon, rubber, metals, and even heavy paper or composites or cardboard. A paintable material has economic and industrial considerations, as mass scale painting is difficult to achieve with quality, and many hobbyists like to paint their own terrain. The terms "top" or "bottom" to describe the module's orientation in the drawings should not be taken to heart to import any such limitations, as those terms are used only to ease the explanation of the module structure. Additionally, some of the embodiments of the invention might require the coupler to be used in a particular orientation, while other embodiments of the invention would be operable with the coupler positioned in several different orientations. When a module structure is made, it would be clear to a person skilled in the art that material saving spaces are a good way to save materials and commonly utilized in manufacturing. The size of a module is not particularly limited in the invention, except by practicality, user preference, economic factors, and industry standards. The 25 mm to 34 mm (1" inch) base scale of the gaming industry is of importance to the overall scale of several embodiments of the invention, since many embodiments are to accommodate play with figurines/modules, but how many gaming bases can be present on the top surface of a given module is not a limitation. For example, the top surface of a single module may accommodate one gaming base, while another module can accommodate nine gaming bases. The thickness of the modules need not be uniform either, as the modular assembly is only simulating a map. If the map texture was intended to be mountainous, variation in the modules thickness could simulate the slope/rise of a mountain trial or cave tunnel. In many embodiments of the invention, a person skilled in the art would recognize that surface distinction could be made by adding to uniform modules, such as the vertical structures, which allows more modularity to the assembly overall.

first side 210 means the first plane of the structure of the module in embodiments of the invention, which is also opposite the second side of the module. The first side and parallel, opposite second side are connected in the structure of the module by the edge sides. The first side of the module is placed side-by-side with other modules in order to form the plane of the modular assembly map that a user might interact with in play. In many embodiments of the invention, the first side is broader than the edge sides of the module, but this is an aesthetic choice more than a limitation to the invention. The first side could be smaller/narrower than the first side, or approximately the same side, but these are economic and practical reasons that a person skilled in the art would appreciate having flat, disc-like structures with broad, first side faces to reduce the materials weight needed to create a map and simplify the user's experience.

top surface 220 means the first side of the module is a physical surface. The top surface of the first side of the module in embodiments of the invention could be broken or unbroken, could have mounting holes cut out of the surface, textured designs or other simulated structures, and other distinctions or features.

textured design 224 means the physical features added to the top surface of the first side of the module in embodiments of the invention. Most commonly, the textured design will be created in sets for the modular assembly, to allow users/customers to purchase a mapscape that fits their gaming needs. It could be as simple as indicating the lines/grid for figuring/model game system special accounting and orientation. For example, in the 25 mm-34 mm (1" in US) base standard square grid or hex-grid, each square or hexagon indicates the space a module/character will occupy and game systems have rules for how to counts the spaces to consistently and fairly indicate distances/movement. Stone floors, wooden ship planks, cave floors star charts, industrial flooring, tile, and other textured designs can be included on their own or with a gaming grid pattern.

mounting hole 226 (at least one) means mounting hole means at least a hole, recess, receiver, slot, or other word to indicate a space for accepting another structure in the top surface of the first side of a module in a map assembly. In embodiments of the invention, the mounting hole in the top surface allows a vertical structure, as described below. The location, size, shape, and manner of the mounting hole is immaterial, as long as it does not compromise the integrity of the modular structure. There are practical benefits to having the location, size, shape, and manner of the mounting holes uniform in a modular assembly. In the drawings, like FIGS. 5, 6, and 7, the mounting hole are shown as two circular holes, opposite of one another, approximately at the midpoint of the side, and set in from the edge sides sufficiently to not clip or destabilize the structure of the edge sides. Similarly, the mounting holes should not compromise the structure of the coupler pocket and/or lug pocket walls. In some embodiments, the mounting holes could accommodate the lugs of the elevator, similar in form to the lug pockets.

second side 230 means the side of the module that is opposite or on the other side of the first side of the module. This is similar to the concept of two sides being from the same coin. The second side of a module should be thought of as the inside space or thickness of the module, and also the plan of space opposite from the first side. In several embodiments of the invention, the second side is mostly empty space, from practical manufacturing choices to save materials. The walls for the coupler pocket/s, and possible lug pockets are the only physical structures in some embodiments of the invention, as seen in FIG. 5. The second side is distinct from the edge sides, only to aid the description/abstraction of embodiments of the invention, as the module is one piece. Economics and practicality are likely to dictate that the materials chosen for the second side would be the same as the other sides, but that is not a requirement/limitation of the present invention. In some embodiments of the invention, different materials or coating might be desired to achieve specific fits with the coupler or other components.

lug pocket 232 means the structure in some embodiments of the invention, in the second side of the module to attach a lug.

coupler pocket 234 (at least one) means the structure of the second side of the module that receiving the coupler head in order to secure the module to at least one adjacent module.

tapered coupler fit 236 (at least one) means that the way the coupler head attaches to the coupler pocket of the second side of the module is by a narrowing of the coupler pocket space such that the coupler becomes more tightly attached as it is pressed into place. In other words, the more the coupler is pressed into the coupler pocket, the tighter the fit. For example, FIG. 3 shows a potential embodiment of the invention with two modules assembled with a coupler, and FIG. 4 shows a cross section of a coupler in a tapered coupler fit with an example coupler pocket in a potential embodiment of the invention. In that example, the space saving side is pressed facing the top surface of the module, which can provide a tighter attachment if there is some flexibility with the space saving side of a potential coupler. There are practical reasons to have a coupler that can be used in either/any orientation, but that is not a limitation of the invention.

edge sides 240 (at least three) means the outer wall of the sides of the modules, the edge material between the first and second side is the edge sides. In many embodiments of invention, the edge sides will be perpendicular to the planes of the first and second sides, but this is not required. The limitations of the edge sides relative to other modules and the modular assembly as a whole, is that the edge sides must be able to meet other edge sides in forming an assembly such that the coupler can be attached/inserted into the coupler pockets of two adjacent modules. Ideally, this should generally create a fairly even surface on the plane of top surfaces, unless crags, crevasses, moats, intentional gaps for cards, or other spaces/depressions/separations are desired to fit the aesthetic of the particular modular assembly. In other words, the edge sides are likely to align flush to an adjacent edge side in many embodiments of the invention, but angled, pitched, rounded, varied, toothed, and other varieties of edge sides could also practice the invention. In some embodiments of the invention, a module has only three sides FIGS. 16 through 20 show different possible three-edged/sided modules, where one edge side is curved/rounded. While the rounded side may or may not have a distinct coupler attachment point, at least one edge side should be attachable with a coupler.

coupler notch 242 (adjoining tapered coupler fit) means the space provided in some embodiments of the invention to accommodate the coupler neck between two adjacent module's coupler pockets. In the embodiments of the drawings, coupler notches are shown accompanying "H"-shaped couplers, like in FIG. 3. The coupler notch allows a flush fit for an embodiment of the coupler that is thicker, and likely sturdier for many materials; compared to a thin coupler-necked coupler that connects to coupler heads with a thin material that requires no coupler notch.

modular assembly 300 means an assembly of at least two modules using at least one coupler and including in some embodiments of the invention, accessory components like vertical structures and elevators. A modular assembly includes its common meaning, which is a representation usually on small scale involving separable components that are interchangeable with others for assembly into units of different size, complexity, or function. Most embodiments of the modular assembly involve integration with industry-standard games and figuring/miniature scales and sizes, such as: 1:76 to 1:64 to 1:58 (25 mm to 28 mm to 34 mm) scale (in the US, known as a "1 inch") such figurines are generally mounted on a round or square base, as described in "gaming figuring base" within this specification. But large-scale versions would certainly still practice an embodiment of the invention, even life-sized embodiments. Smaller scale models exist, and such modular assemblies are encompassed in embodiments of the invention.

elevator 310 means a simple structure that includes at least one lug used as a base to allow at least one module to be placed at a higher, raised, or above plane so as to create, or simulate a second floor or level for the map. The elevator shape is only limited by being able to provide a level structure for the module use on the second floor, and of a height appropriate to the scale to create a second floor that aligns with the stain assembly. In some embodiments, the elevator is a cubical or rectangular block with for square lugs on one side to engage with the lug pockets. In some embodiments there may be lugs on the opposite side as well to mount the elevator into mounting holes of a module on the main level, but in that configuration, the elevators must be differently to accommodate the lug 316 (at least one) means any sort of protrusion or structure from the elevator that can be used to place or otherwise secure a module to the elevator. FIG. 24 for example, shows four square lugs that would fit within the lug pockets from the second sides of a module that might be place on top of an elevator. The lug may or may not create a tapered fit with the lug pocket.

vertical structure 320 (at least one/plurality of/attaches to a module by at least one mounting hole) means the accessory components that can be added to a modular assembly and these accentuate the map with tangible details for the enjoyment of the user(s). Vertical structures are distinct from the modules, which create the 'floor' of the modular assembly; whereas the vertical structures create other features for the modular assembly. A large square dungeon room, for example, might have two doors, several walls, and a stair assembly, or a narrow hallway might have halls on either length with doors on each end. A large square cave room, for example, might have stalagmites, boulders, cave walls, mysterious pools of water, and openings or passages in the cave walls. The materials for vertical structures are limited to solid materials that are safe for human handling, and conducive to the general wear and tear of use. Ideal materials are often selected from a combination of many factors, including expense, durability, production/craft time, weight, customer preference, and others. Various plastics are clear choice, but the embodiments of the invention could also be various woods, stone or other minerals, silicon, rubber, metals, and even heavy paper or composites or cardboard. A paintable material has economic and industrial considerations, as mass scale painting is difficult to achieve with quality, and many hobbyists like to paint their own game pieces, like the vertical structures here. In many embodiments, the vertical structure will also have a textured design, likely to match the theme of the assembly, and the textured design of the modules.

door 322 means a specifically of vertical structure accessory component of the modular assembly. The common meaning of the term in intended, as well as in the modeling representational sense, but also any sort of threshold, passage, gate, entrance, exit, barrier, portal, or other space for conveyance from one space to another. In a full modular assembly, there are likely to be multiple door options, and styled to match any particular theme or textured design or the modules. In play, for example, a door may begin as a closed door, then be replaced with a barred door or open doorway one the players resolve the room requirements. Doors in some embodiments could be functionably movable; in that the doors could be "opened" and/or "closed", like a life-sized door. Doors in the embodiments would be "swappable" with wall 324 means the common meaning, but also any representation that would be appropriate in the context of the invention/fields of art, like: corn rows, trees, row of bushes, shoreline, fences, spikes, or others. More traditional walls could represent or simulate walls that appear to be plaster, wood plank, columns, brick, stone blocks, uneven stone, crypt walls, cave walls, dungeon, castle, steel, iron, barn, urban materials, concrete, tile, clay, or other kinds. Walls could be of a proportional height to the scale of the figurines used, but in several embodiments of the invention, short walls, perhaps 'shin' high to the scale of setting to be conveyed without tall walls that hamper or hinder the user from reaching and/or moving their figurines.

stair assembly 326 means a type of vertical structure that includes at least two stair stringers and at least two tread connectors. In other embodiments, the stair riser is not a board as in a classic staircase design, but is an open space that creates an open stair riser. In yet other embodiments the open stair riser and the tread connectors create a tuck-in space where a gaming base edge can be tucked into the open stair riser, so that the gaming base may rest on one of the tread connectors such that the figurine on the gaming base is on the stair assembly, as if it were on its way up or down the stairs of a modular assembly. The stair assembly will be of the same scale as the modular assembly, and in several embodiments, scaled so as to accommodate a standard sized gaming base for the industry. In other embodiments, the scale of the modular assembly could be life-sized, and so to would be the stairs. In the embodiments shown in FIG. 22 and FIG. 23, a person skilled in the art would appreciate the convenience of plastic materials, and that specifically the exploded view of FIG. 23 shows a potential assembly based on providing the separate components on a plastic mold sprue, which would then be assembled by the purchaser/user. In that same embodiment, lugs and pockets are used to join the pieces, but several common shapes and types of joints could be used to attach the components together to create the stair assembly.

stair stringer 330 (at least two) means the part of the stair assembly that comprises the side parts of a staircase structure, and includes the common meaning of stair stringer in the industry. There must be at least two stair stringers, one on each side, so as to support the tread connectors and the weight of whatever may use the stairs.

tread connector 332 (at least two) means the part of the stair assembly that comprises the 'step' of the stairs, which is the common meaning in of a tread in the industry. There are at least two tread connectors on the stair assembly in order to create height necessary for the raised plane by use of the elevator. And in more specific embodiments of the stair assembly, there must be two tread connectors in order to create the tuck-in space. The embodiment of the stair assembly, as shown in FIG. 22, shows a total of four tread connectors with an open stair riser that creates three potential tuck-in spaces.

open stair riser 334 (at least one) means the part that is commonly called the 'riser' in the industry is missing in the stair assembly, and the space between the tread connectors is open space. In some embodiments of the invention, the open stair riser allows for a tuck-in space with use of a figurine gaming base.

tuck-in space 336 means a further limitation of an open stair riser where the open stair riser also allows a figurine that is mounted on a standard figurine gaming base to be set upon a step or tread connector. To set a figurine on a particular step, the edge of the figurine gaming base should be slid into the open stair riser space between the tread connector the figurine gaming base is set upon and the treat connector above it, such that the tread connector above the tread connector that the gaming base is resting upon acts to prevent tipping of the figurine off the stair assembly. This allows the figurine to successfully inhabit the actual space of the stairs if a user's 'character' wishes to be represented as being on the stair case, rather than having to physically set the figurine aside and inhabit the space abstractly because the structure cannot safely stabilize the figurine on the structure such that it can remain on the stair structure independently once positioned. In other words, if the figurine were resting on a tread connector that could be thought of as a fulcrum and the gaming base as the lever, the tuck-in space would prevent the lever from tipping, even if the load of the figurine were unbalanced toward the opposite end of the lever.

gaming base edge means the common meaning of a base structure used to mount a figurine or model or miniature in the role playing and gaming industry. Figurine scales of 20 mm, 25 mm, 28 mm, 30 mm, 32 mm, and 35 mm are the most common for role-playing and table-top games. Smaller scales of 2 mm, 6 mm, 10 mm, 15 mm, and 20 mm are used for mass-combat wargames. Painters and collectors commonly use larger figures of 54 mm or more but 40 mm and 54 mm have never been completely abandoned by wargamers and have become popular again since the late 20th century although not as popular as the smaller sizes.

One embodiment example is a modular assembly comprising: at least two modules connected by a coupler; each of the at least two modules include a first side which is opposite a second side, yet connected to the second side by at least three edge sides; the first side includes a top surface, the second side includes at least one coupler pocket with a tapered coupler fit, and the at least three edge sides include a coupler notch adjoining the tapered coupler fit of the second side; these at least two modules are oriented in a way that at least one of their at least three edge sides line up to receive the coupler which has two substantially oblong shaped coupler heads which are oppositely arranged and connected by at least one coupler neck and makes a tapered coupler fit into the coupler pockets of the at least two adjacent modules.

Another embodiment example is a modular assembly comprising at least two modules connected by a coupler where the coupler is overall substantially "H" shaped.

Another embodiment example is a modular assembly with at least two modules further comprising of a first side and a second side on opposite sides, connected by at least three edge sides. The second side of each of the at least two modules has at least one lug pocket.

Another embodiment example is a modular assembly comprising an elevator with at least one lug which connects to the lug pocket on the second side of each of the at least two modules, to create a raised plane in the modular assembly.

Another embodiment example is a modular assembly with at least two modules, where the top surface of the first side of each of the two modules includes at least one mounting hole.

Another embodiment example is a modular assembly with at least two modules, where the top surface of the first side of each of the two modules includes at least one mounting hole which attaches to at least one vertical structure.

Another embodiment example is a modular assembly with at least two modules, where the top surface of the first side of each of the two modules includes at least one mounting hole which attaches to at least one vertical structure, which is a door.

Another embodiment example is a modular assembly with at least two modules, where the top surface of the first side of each of the two modules includes at least one mounting hole which attaches to at least one vertical structure, which is a wall.

Another embodiment example is a modular assembly with at least two modules, where the top surface of the first side of each of the two modules includes at least one mounting hole which attaches to at least one vertical structure, which is a stair assembly with at least two stair stringers and at least two tread connectors.

Another embodiment example is a modular assembly with at least two modules containing a mounting hole on the top surface of the first side of each module, which is connected to stair assembly with at least two stair stringers and at least two tread connectors; this stair assembly also includes at least one open stair riser.

Another embodiment example is a modular assembly with at least two modules containing a mounting hole on the top surface of the first side of each module, which is connected to stair assembly with at least two stair stringers and at least two tread connectors, and at least one open stair riser connecting to form a tuck in space to accommodate a gaming base edge on one of the at least two tread connectors.

Another embodiment example is a modular assembly where the vertical structure attaching to the mounting hole on the at least two modules can either be a stair assembly, a door, a wall, or any combination of them.

Another embodiment example is a coupler with at least two coupler heads connected by at least one coupler neck.

Another embodiment example is a coupler with at least two substantially oblong shaped coupler heads which are oppositely arranged and connected by one coupler neck.

Another embodiment example is a substantially "H"-shaped coupler.

Another embodiment example is a module comprising: a first side with a top surface, a second side with at least one coupler pocket opposite to the first side, and both the first side and the second side are connected by at least three edge sides.

Another embodiment example is a module comprising of a first side and a second side having at least one coupler pocket which is a tapered coupler fit.

Another embodiment example is a module where the coupler pocket on the second side is a tapered coupler fit and has at least three edge sides with a coupler notch which is adjoined to the tapered coupler fit.

Another embodiment example is a module where the second side includes at least one lug pocket.

Another embodiment example is a module where the top surface of the first side of the module includes at least one mounting hole.

Another embodiment example is a module where the top surface of the first side of the module is textured.

What is claimed is:

1. A modular assembly for gaming, comprising:
at least two modules connected by at least one coupler;
the at least two modules each including,
a first side,
the first side is opposite a second side,
the first side and the second side are connected by at least three edge sides,
the first side including a top surface,
the second side including at least one coupler pocket,
the at least one coupler pocket of the second side includes a tapered coupler fit by a narrowing of the at least one coupler pocket from the second side towards the first side,
the at least three edge sides include a coupler notch, and
the coupler notch is adjoining the tapered coupler fit of the second side;
the at least two modules are oriented to have at least one of their at least three edge sides adjacent to another module edge side, such that the coupler pockets of the adjacent modules lined up to receive the coupler;
the at least one coupler includes,
a top side, a space saving side, two substantially oblong-shaped coupler heads,
the two substantially oblong-shaped coupler heads are oppositely arranged from each other and connected by one coupler neck, and
the at least one coupler makes a tapered coupler fit between the coupler pocket of the at least two adjacent modules by the space saving side of the at least one coupler being compressed first into the narrowing of at least one coupler pocket from the second side toward the first side of the adjacent modules.

2. The modular assembly of claim 1, further comprising:
the at least one coupler is overall substantially "H"-shaped.

3. The modular assembly of claim 2, further comprising:
the second side of the at least two modules include at least one lug pocket.

4. The modular assembly of claim 3, further comprising:
an elevator including at least one lug that connects to the at least one lug pocket of the second side of the at least two modules, to create a raised plane in the modular assembly.

5. The modular assembly of claim 4, further comprising:
the top surface of the first side of the at least two modules includes at least one mounting hole.

6. The modular assembly of claim 5, further comprising: the at least one mounting hole attaches to at least one vertical structure.

7. The modular assembly of claim 6, further comprising: the at least one vertical structure is a door.

8. The modular assembly of claim 6, further comprising: the at least one vertical structure is a wall.

9. The modular assembly of claim 6, further comprising: the at least one vertical structure is a stair assembly, the stair assembly including at least two stair stringers and at least two tread connectors.

10. The modular assembly of claim 9, further comprising: the stair assembly includes at least one open stair riser.

11. The modular assembly of claim 10, further comprising:

the at least one open stair riser of the stair assembly and the at least two tread connectors provide a tuck-in space, and the tuck in space is configured to accommodate a gaming base edge on one of the at least two tread connectors.

12. The modular assembly of claim 11, further comprising:

the at least one vertical structure attaching to the at least one mounting hole on the at least two modules is a plurality of vertical structures, including at least one stair assembly, at least one door, and at least one wall.

13. A method of use for the modular assembly of claim 12, comprising the steps of:

arranging a plane of at least two modules such that the first sides are arranged on the same plane and the edge sides are adjoining each other;

securing the at least two modules together by pressing the couplers into the coupler pockets and coupler notches where the at least two module edge sides are adjacent;

attaching any stair assemblies, doors, or walls, as desired;

positioning an elevator by any stair assembly attached to the modules, and attaching additional modules to the elevator by putting the at least one lug of the elevator into the at least one lug pocket of the module to create a raised plane on the modular assembly; and adding additional elevators and modules to the raised plane modular assembly, as desired.

14. A method of making the modular assembly of claim 1, comprising the steps of:

making at least two modules and at least one coupler;

making the at least two modules each of which include: a first side having a top surface, a second side opposite the first side, and the first side and the second side connected by at least three edge sides;

making the second side of the modules to have at least one coupler pocket;

making the at least one coupler pocket of the second side of the modules to have a tapered coupler fit; by a narrowing of the at least one coupler pocket from the second side towards the first side;

making the at least three edge sides of the modules with a coupler notch, and making the coupler notch in the edge side of the module adjoin the tapered coupler fit of the coupler pocket of the second side of the module; and making the at least one coupler to include two substantially oblong-shaped coupler heads oppositely arranged from each other and connected by one coupler neck.

15. The method of making the modular assembly of claim 14, comprising the additional steps of:

making at least one mounting hole in the top surface of the first side of at least one of the modules;

making a plurality of vertical structures that can attach to the at least one mounting hole, including: at least one wall, at least one door, and at least one stair assembly that has at least two stair stringers, at least two tread connectors, and at least one open stair raiser;

making the second side of the at least two modules include at least one lug pocket; and making at least one elevator with at least one lug that can attach to the at least one lug pocket on the second side of the at least one of the modules.

16. A method of use for the modular assembly of claim 1, comprising the steps of:

arranging a plane of at least two modules such that the first sides are arranged on the same plane and the edge sides are adjoining each other, and securing the at least two modules together by pressing the couplers into the coupler pockets and coupler notch spaces where the at least two module edge sides are adjacent.

* * * * *